US007455502B2

(12) United States Patent
Spaggiari

(10) Patent No.: US 7,455,502 B2
(45) Date of Patent: Nov. 25, 2008

(54) AXIAL FAN

(75) Inventor: Alessandro Spaggiari, Correggio (IT)

(73) Assignee: SPAL Automotive S.R.L., Correggio (IT)

( * ) Notice: Subject to any disclaimer, the term of this patent is extended or adjusted under 35 U.S.C. 154(b) by 359 days.

(21) Appl. No.: 10/550,279

(22) PCT Filed: Feb. 1, 2005

(86) PCT No.: PCT/IB2005/000239

§ 371 (c)(1),
(2), (4) Date: Sep. 23, 2005

(87) PCT Pub. No.: WO2005/075831

PCT Pub. Date: Aug. 18, 2005

(65) Prior Publication Data

US 2006/0251509 A1 Nov. 9, 2006

(30) Foreign Application Priority Data

Feb. 3, 2004 (IT) ..... BO2004A0047

(51) Int. Cl.
*F03B 11/08* (2006.01)

(52) U.S. Cl. ..... 416/93 R

(58) Field of Classification Search ..... 415/121.2; 416/93 R

See application file for complete search history.

(56) References Cited

U.S. PATENT DOCUMENTS 2,409,497 A * 10/1946 Kessel ..... 99/511
3,303,995 A * 2/1967 Boeckel ..... 417/353
3,885,888 A * 5/1975 Warhol ..... 416/175
4,840,645 A * 6/1989 Woodworth et al. ..... 95/270
5,921,746 A * 7/1999 Yu et al. ..... 415/55.1

FOREIGN PATENT DOCUMENTS

| | | |
|---|---|---|
| DE | 39 41 612 A1 | 6/1991 |
| FR | 2 815 676 | 4/2002 |
| WO | 03/010438 A1 | 2/2003 |

* cited by examiner

*Primary Examiner*—Edward Look
*Assistant Examiner*—Aaron R Eastman
(74) *Attorney, Agent, or Firm*—Nath Law Group; Jerald L. Meyer; Jon A. Kidney

(57) ABSTRACT

Described is an axial fan in which an impeller (1) comprises a hub (2), motor-powered so that it rotates about its own central axis (3) and a plurality of blades (5) extending from the hub (2) in directions transversal to the hub (2) axis of rotation (3); the hub having a cup shape and formed by a ring-shaped side wall (7) and a bottom wall (6) which has a plurality of long ribs (20) arranged in a radial direction and extending in height towards the hub (2) cavity, each of the ribs (20) abutting on the internal face of the ring-shaped side wall (7) and delimiting, together with said ring-shaped side wall, a corner area of the bottom wall (6) positioned in front of the rib (20) with reference to the hub (2) direction of rotation (V); each corner area having a through-hole (9) for discharging any debris, in particular water, sand, soil or sludge, from the hub (2) cavity to the outside of the hub (2) The through-holes (9) are evenly distributed along a circle centered on the hub (2) axis of rotation (3) and have a substantially triangular prismatic shape with a vertex wall (15) facing forwards according to the hub (2) direction of rotation (V).

9 Claims, 2 Drawing Sheets

AXIAL FAN

TECHNICAL FIELD

The present invention relates to an axial fan.

More precisely, the fan according to the present invention may be used in a system for cooling the engine of a vehicle, in particular an agricultural vehicle, to which the following description refers, without in any way limiting the scope of the invention.

BACKGROUND ART

Generally speaking, an engine cooling system comprises a radiator, which is part of a cooling circuit designed to dissipate into the environment the heat which a liquid circulating inside it carries away from the engine, and an axial fan, which generates a forced air flow through the radiator to promote the latter's dissipation of the heat.

The fan may be driven by an electric motor, and comprises an impeller whose rotation is driven by the shaft of the electric motor. A thermostat which detects the temperature of the liquid in the cooling circuit controls activation of the electric motor, which keeps running until the temperature of the cooling liquid detected returns below a predetermined limit value. In other solutions the fan is driven by various types of known actuator devices, for example viscostatic couplings or electromagnetic couplings, whose rotation is in turn driven by the engine.

The impeller comprises a plurality of blades, each with its base secured to a hub which is coaxially fixed to the shaft of the electric motor. The blades extend radially from the hub, may have various profiles and be at various angles to the hub axis of rotation, and in most cases their ends opposite the base are fixed to a stiffening ring, which encloses the blades and is centred on the impeller axis of rotation.

The hub normally has a cylindrical cup shape, so that it at least partly encloses and protects the electric motor.

Axial fans of the type described above have several disadvantages, in particular if used with the cooling circuit of an agricultural vehicle. In the most common working conditions for agricultural vehicles it is quite easy for water, sand and soil to build up in the air space between the electric motor, or the viscostatic coupling, and the impeller hub, creating a sludge that may cause problems with fan operation.

DISCLOSURE OF THE INVENTION

One aim of the invention is to provide an improved axial fan which is reliable even when operating in particularly difficult environmental conditions.

Another aim of the invention is to provide an improved axial fan which is simple and economical to produce.

Yet another aim of the invention is to provide an improved axial fan which can be assembled by existing production lines without modifying them.

According to one aspect of it, the present invention provides an axial fan as defined in claim 1.

The dependent claims refer to preferred, advantageous embodiments of the invention.

BRIEF DESCRIPTION OF THE DRAWINGS

The accompanying drawings illustrate a preferred embodiment of the present invention without limiting the scope of its application, and in which.

DETAILED DESCRIPTION OF THE PREFERRED EMBODIMENTS OF THE INVENTION

Figure 1:
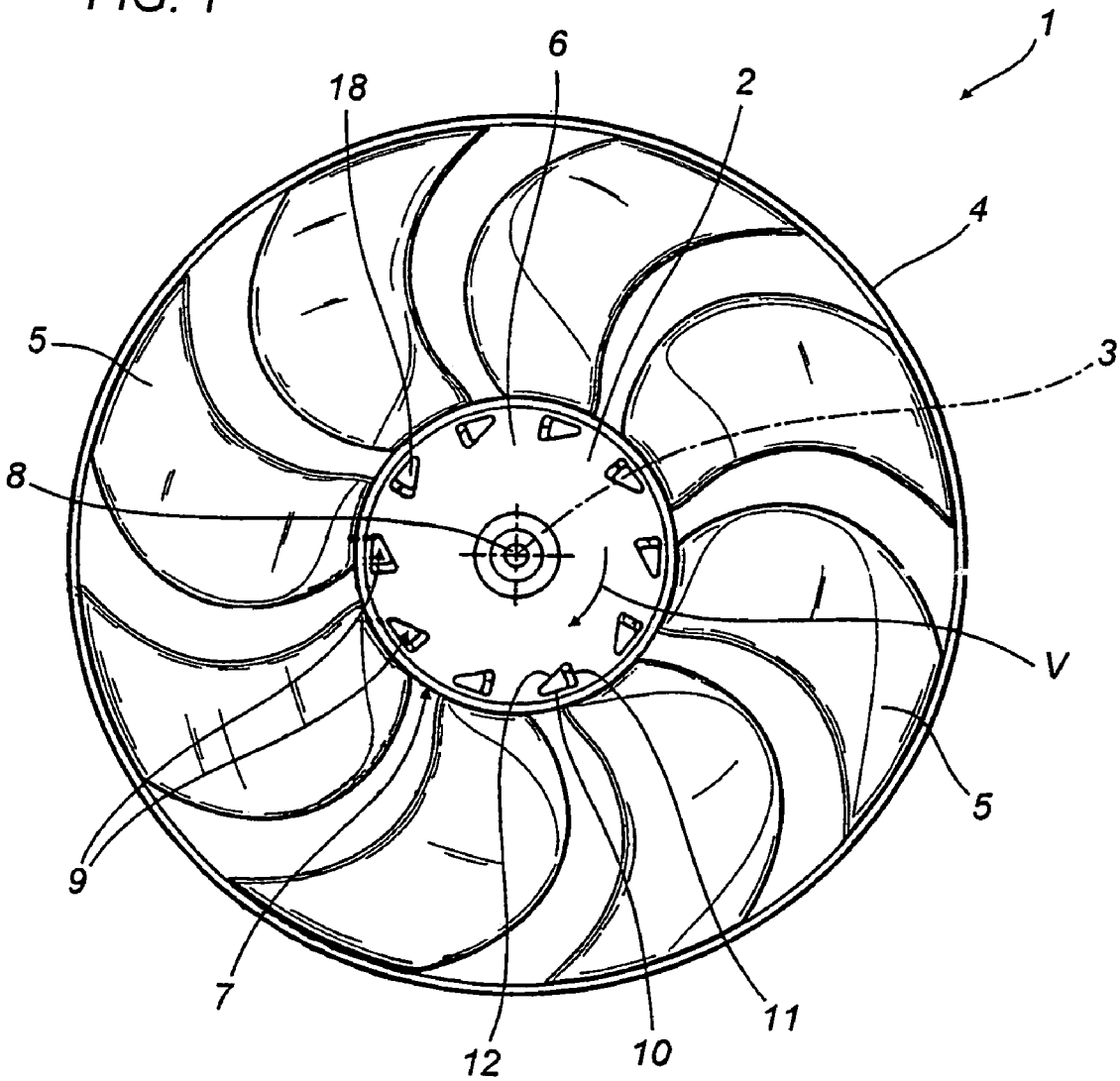
FIG. 1 illustrates the impeller of an axial fan made according to the present invention.

With reference to FIG. 1, the numeral 1 denotes an impeller of an axial fan which can be used to particular advantage with a cooling circuit (not illustrated) of an engine of an agricultural vehicle (also not illustrated).

The impeller 1 comprises a hollow central hub 2, extending substantially symmetrically about its central axis of rotation 3, a stiffening ring 4, centred on the axis 3 and surrounding the hub 2, and a plurality of blades 5, eight in the embodiment illustrated in FIG. 1, each extending between the hub 2 and the ring 4 in a direction transversal to the axis 3.

Figure 2:
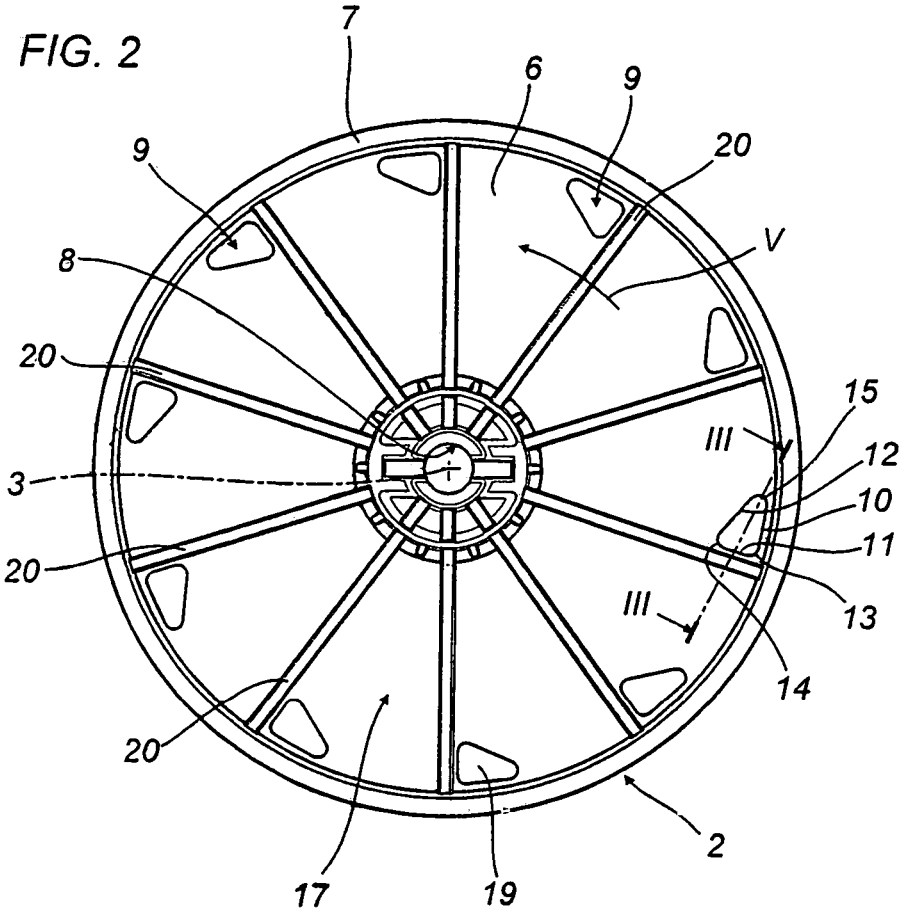
FIG. 2 is a plan view of a detail of the impeller illustrated in FIG. 1.

In the known way, the hub 2 is coaxially fixed to the shaft of an electric motor or any actuator device (not illustrated), which allows the impeller 1 and therefore the hub 2 to turn about the axis 3 in the direction V illustrated in FIGS. 1 and 2.

In the embodiment illustrated in FIG. 1, the blades 5 are positioned around the axis 3 and extend radially from the hub 2 with a profile and angle determined relative to the axis 3, the ring 4 stiffens the blades 5 and the entire impeller 1.

Obviously, the present invention may also be applied to different configurations with the blades in any position, with or without the stiffening ring.

Figure 3:
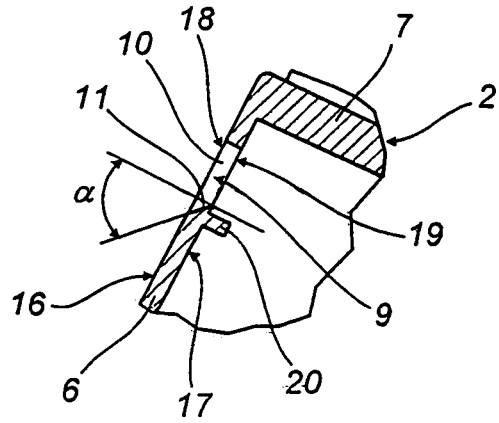
FIG. 3 is a cross-section through line III-III in FIG. 2.

The hub 2, illustrated in detail in FIGS. 2 and 3, has a cylindrical cup shape, so that it at least partly encloses and protects the electric motor or the other actuator devices.

The hub 2 consists of a bottom wall 6 and a ring-shaped side wall 7, extending symmetrically relative to the axis 3 to enclose and protect the electric motor or the other actuator devices. The blades 5 are connected to the outer face of the wall 7 at their bases and to the ring 4 at their outer tips.

The wall 6 has a central through-hole 8 for fixing it to the shaft of the motor or the other actuator devices.

The wall 6 also has a plurality of outer through-holes 9, ten in the embodiment illustrated, evenly distributed along a circle centred on the axis 3 and close to the wall 7.

Each of the holes 9 has a substantially triangular prismatic shape and, with reference to the direction of the axis 3 and to the direction V, is delimited by a flat external wall 10, lying in a plane at a right angle to a radial direction and to the wall 6, and by a flat rear wall 11, lying in a plane parallel with a radial direction and angled backwards by a predetermined angle "$\alpha$" relative to the direction of the axis 3, and by a flat internal wall 12, lying in an oblique plane relative to a radial direction and at a right angle to the wall 6.

Again with reference to the direction of the axis 3 and to the direction V, the walls 10 and 11 converge towards a rear, external curved vertex wall 13, the walls 11 and 12 converge towards a rear, internal curved vertex wall 14, and the walls 10 and 12 converge towards a front curved vertex wall 15. Therefore, the walls 13, 14 and 15 act as connecting walls and also delimit the hole 9.

The angle "$\alpha$" is preferably between 30° and 60°, more preferably equal to 45° as illustrated in FIG. 3, and is such that it gives the hole 9 a rear flaring from the inside of the hub 2 to the outside of the hub 2. In other words, where the numerals 16 and 17 denote the external face and, respectively, the internal face of the wall 6, the walls 10-15 and the face 16 form an external mouth 18 of the hole 9 whose area is greater, more precisely longer in the direction opposite to direction V, than the area of the internal mouth 19 of the hole 9 formed by the walls 10-15 and the face 17.

The mouths 18 and 19 have respective triangular shapes with rounded vertices due to the curvature of the walls 13, 14 and 15.

Towards the hub 2 cavity, from the face 17 of the wall 6 there extend, squarely in height and in a direction with radial length, a plurality of long stiffening ribs 20 which abut on the internal face of the ring-shaped side wall 7.

The number of holes 9 is equal to the number of ribs 20 (ten in the embodiment illustrated) and, with reference to the direction of rotation V, they are arranged immediately in front of each rib 20 with the respective angled wall 11 close to the rib.

As described below, each rib 20, as well as being a hub 2 stiffening element, is also an element for collecting debris (and/or water, condensation, etc.) and guides and drains said debris towards the inside of the hub 2.

As a result, the hole 9 and the wall 11 form a natural outlet for the above-mentioned debris and/or water, condensation, etc.

The holes 9 are intended to promote the discharge of debris, more particularly water, sand, soil and sludge which, if left to build up in the air space between the electric motor (or the other actuator devices) and the hub 2, could cause problems with fan operation.

The discharge of debris through the holes 9 is promoted by the outer position of the holes 9, which are close to the wall 7, and by the fact that the ribs 20 are close to them.

The debris to be discharged, pushed by the ribs 20, flows towards the wall 7 driven by centrifugal force, and the double barrier formed by the wall 7, on one hand, and by each of the ribs 20, on the other hand, guides the debris through the holes 9.

The flow of debris through the holes 9 from the inside to the outside of the hub 2 is promoted by the fact that the above-mentioned rear walls 11 are angled backwards. In other words, with reference to the direction of rotation V of the impeller, the wall 7 delimits, together with each of the ribs 20, a corner area of the bottom wall 6 in the zone in front of the rib 20. The debris to be discharged accumulates in said area, and the hole 9 for removal of the debris is located in that corner area.

In the corner area the hole 9 is positioned with its wall 10 substantially acting as an extension of the wall 7 and with its wall 11 substantially acting as an extension of the rib 20.

The shape selected for the holes 9 also allows a low sound intensity to be obtained and does not cause aerodynamic whistling during rotation of the impeller 1.

In an embodiment not illustrated, but immediately deducible from the above description, the number of holes 9 and ribs 20 is a predetermined number other than ten.

The invention may be subject to other practical-application modifications without thereby departing from the scope of the inventive concept, as set out in the claims.

LIST OF REFERENCE CHARACTERS

1 Impeller
2 Hub
3 Impeller axis of rotation
4 Ring
5 Blades
6 Hub bottom wall
7 Hub side wall
8 Central hole in hub
9 Outer holes in hub
10-15 Walls delimiting holes 9
16 External face of wall 6
17 Internal face of wall 6
18 External mouth of hole 9
19 Internal mouth of hole 9
20 Rib
V Impeller direction of rotation
α Angle

The invention claimed is:

1. An axial fan in which an impeller (1) comprises a hub (2), motor-powered so that it rotates about its own central axis (3) in a predetermined direction of rotation (V), and a plurality of blades (5) extending from the hub (2) in directions transversal to the axis (3);

the hub (2) having a cup shape and being formed by a bottom wall (6) and a ring-shaped side-wall (7);

the bottom wall (6) having a plurality of long ribs (20) arranged in a radial direction and extending in height towards the hub (2) cavity, each of the ribs (20) abutting on an internal face of the ring-shaped side wall (7) and delimiting, together with said ring-shaped side wall (7), a corner area of the bottom wall (6) positioned in front of the rib (20) with reference to the direction of rotation (V);

the fan being characterized in that each corner area has a through-hole (9) for discharging any debris, in particular water, sand, soil or sludge, from the hub (2) cavity to the outside of the hub (2);

in each of said corner areas the through-hole (9) is delimited by at least three walls (10-15), of which a first wall (10) substantially acts as an extension of the ring-shaped side wall (7) and of which a second wall (11) substantially acts as an extension of the rib (20);

each of the said through-holes (9) being positioned between two circumferentially adjacent ribs (20) and substantially closer to one adjacent rib (20) than the other.

2. The fan according to claim 1, characterised in that the through-holes (9) are evenly distributed along a circle centred on the axis (3) and close to the ring-shaped side wall (7).

3. The fan according to claim 1, characterised in that the through-holes (9) have a substantially triangular prismatic shape.

4. The fan according to claim 1, characterised in that, with reference to the direction of the axis (3) and to the direction of rotation (V) of the hub (2), each through-hole (9) is delimited by at least three walls (10-15), of which a first flat external wall (10) lies in a plane at a right angle to a radial direction and to the bottom wall (6).

5. The fan according to claim 4, characterised in that, with reference to the direction of the axis (3) and to the direction of rotation (V) of the hub (2), the first and second walls (10, 11) converge towards a rear, external curved vertex wall (13); the second and third walls (11, 12) converge towards a rear, internal curved vertex wall (14); and the first and third walls (10, 12) converge towards a front curved vertex wall (15).

6. The fan according to claim 1, characterised in that, with reference to the direction of the axis (3) and to the direction of rotation (V) of the hub (2), each through-hole (9) is delimited by at least three walls (10-15), of which a second flat rear wall (11) lies in a plane parallel with a radial direction and is angled backwards by a predetermined angle (Q) relative to the direction of the axis (3).

7. The fan according to claim 6, characterised in that the predetermined angle (α) is between 30° and 60°.

8. The fan according to claim 7, characterised in that the predetermined angle (α) is equal to 45°.

9. The fan according claim 1, characterised in that, with reference to the direction of the axis (3) and to the direction of rotation (V) of the hub (2), each through-hole (9) is delimited by at least three walls (10-15), of which a third flat internal wall (12) lies in an oblique plane relative to a radial direction and at a right angle to the bottom wall (6).

* * * * *

UNITED STATES PATENT AND TRADEMARK OFFICE

CERTIFICATE OF CORRECTION

PATENT NO. : 7,455,502 B2
APPLICATION NO. : 10/550279
DATED : November 25, 2008
INVENTOR(S) : Alessandro Spaggiari It is certified that error appears in the above-identified patent and that said Letters Patent is hereby corrected as shown below:

Claim 6, Column 4, Line 62,

Please delete "predetermined angle (Q)"

and replace with

-- predetermined angle (α) --

Signed and Sealed this

Third Day of February, 2009

John Doll

JOHN DOLL
*Acting Director of the United States Patent and Trademark Office*